US012662726B2

(12) United States Patent
Bobel et al.

(10) Patent No.: US 12,662,726 B2
(45) Date of Patent: Jun. 23, 2026

(54) ALUMINUM EXTRUSIONS INCLUDING CO-EXTRUDED INSULATED, COATED AND/OR NON-CIRCULAR SHAPED REINFORCING WIRES

(71) Applicant: GM GLOBAL TECHNOLOGY OPERATIONS LLC, Detroit, MI (US)

(72) Inventors: Andrew Clay Bobel, Troy, MI (US); Diptak Bhattacharya, Royal Oak, MI (US); Jeffrey A. Abell, Rochester Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 209 days.

(21) Appl. No.: 18/406,696

(22) Filed: Jan. 8, 2024

(65) Prior Publication Data

US 2025/0223680 A1 Jul. 10, 2025

(51) Int. Cl.

| | |
|---|---|
| ***C22C 49/06*** | (2006.01) |
| ***C22C 47/04*** | (2006.01) |
| ***C22F 1/04*** | (2006.01) |

(52) U.S. Cl.

CPC ..... *C22C 49/06* (2013.01); *C22C 47/04* (2013.01); *C22F 1/04* (2013.01)

(58) Field of Classification Search

CPC ..... B21C 23/22; B21C 23/142; C22C 49/06; C22C 47/02; C22C 47/04

See application file for complete search history.

(56) References Cited

U.S. PATENT DOCUMENTS

| | | | | |
|---|---|---|---|---|
| 3,919,764 | A | 11/1975 | Berghezan | |
| 4,005,255 | A * | 1/1977 | Wagner | B60M 1/302 428/602 |
| 6,003,356 | A * | 12/1999 | Mills | B21C 23/002 72/268 |

OTHER PUBLICATIONS

Morasch, A. et al. "Characterization of debonding strength in steel-wire-reinforced aluminum and its influence on material fracture". http://dx.doi.org/10.1016/j.engfracmech.2015.05.029. Engineering Fracture Mechanics 141 (2015) 242-259.

Merzkirch, Mattias et al. "Cyclic deformation and damage behaviour of the spring steel wire reinforced aluminium alloy EN A W-6082". DOI 10.1007/s10853-013-7913-5; Published online: Dec. 12, 2013; J Mater Sci (2014) 49:2187-2203.

Reeb, Andreas. et al. "Heat treatment during composite extruded spring steel wire reinforced EN AW-6082". http://dx.doi.org/10.1016/j.jmatprotec.2015.08.022. Journal of Materials Processing Technology 229 (2016) 1-8.

German Office Action from counterpart DE1020241046074, dated Oct. 4, 2024.

* cited by examiner

*Primary Examiner* — Adam Krupicka

(57) ABSTRACT

A co-extruded part includes an aluminum extrusion and a plurality of reinforcing wires. The plurality of wires include an outer coating layer, a non-circular cross section, and/or an outer layer including woven glass fibers. The plurality of wires are arranged in the aluminum extrusion. The plurality of reinforcing wires are co-extruded with the aluminum extrusion.

20 Claims, 5 Drawing Sheets

ALUMINUM EXTRUSIONS INCLUDING CO-EXTRUDED INSULATED, COATED AND/OR NON-CIRCULAR SHAPED REINFORCING WIRES

INTRODUCTION

The information provided in this section is for the purpose of generally presenting the context of the disclosure. Work of the presently named inventors, to the extent it is described in this section, as well as aspects of the description that may not otherwise qualify as prior art at the time of filing, are neither expressly nor impliedly admitted as prior art against the present disclosure.

The present disclosure relates to aluminum extrusions, and more particularly to aluminum extrusions including co-extruded insulated, coated and/or non-circular shaped reinforcing wires.

Extruded aluminum parts can be used in a variety of applications as a replacement for steel parts to reduce weight. While aluminum weighs less than steel, aluminum has lower strength than steel. For example, vehicles may include extruded aluminum parts that replace steel parts. However, it may be difficult to replace some steel structural parts with aluminum due to its lower strength.

SUMMARY

A co-extruded part includes an aluminum extrusion and a plurality of reinforcing wires including an outer coating layer and arranged in the aluminum extrusion. The plurality of reinforcing wires is co-extruded with the aluminum extrusion.

In some examples, the aluminum extrusion is made of an aluminum alloy selected from a group consisting of 6034, 6061, 6082, 6282, 7003, 6063, 6005, 6008, 1050, 3103, 3003 and/or 7075. The plurality of reinforcing wires are made of a material selected from a group consisting of iron (Fe), copper (Cu), nickel (Ni), titanium (Ti), and alloys thereof. The plurality of reinforcing wires are made of a material selected from a group consisting of carbon steel, austenitic stainless spring steel, and martensitic stainless spring steel. The outer coating layer is made of a material selected from a group consisting of zinc, zinc-magnesium, zinc-magnesium-aluminum, copper, and copper-zinc. The outer coating layer includes a zinc-based alloy that melts during extrusion to create a liquid diffusion bond. The outer coating layer includes a copper-based alloy that does not melt during extrusion to create a solid-state diffusion bond. The plurality of reinforcing wires have a diameter in a range from 0.5 mm to 2 mm.

In other features, a thickness of the outer coating layer is in a range from 1 μm to 50 μm. A surface of the outer coating layer has a surface roughness (Ra) in a range from 10% to 75% of an average thickness T of the outer coating layer.

In other features, the outer coating layer includes an insulating layer selected from a group consisting of aluminum nitride (AlN), alumina (Al2O3), and boron nitride (BN). The plurality of reinforcing wires have a non-circular cross section. The plurality of reinforcing wires comprise helical reinforcing wires including a longitudinal helical groove.

A co-extruded part includes an aluminum extrusion and a plurality of reinforcing wires. The plurality of reinforcing wires are co-extruded with the aluminum extrusion. A cross sectional shape of the plurality of reinforcing wires is a non-circular cross-sectional shape. The non-circular cross-sectional shape is selected from a group consisting of a "D"-shape, a crescent-shape, a pie-shape, an elliptical-shape, a rounded rectangular shape, a helix shape, and a rounded triangle shape. The plurality of reinforcing wires include an outer coating layer.

In other features, the aluminum extrusion is made of an aluminum alloy selected from a group consisting of 6034, 6061, 6082, 6282, 7003, 6063, 6005, 6008, 1050, 3103, 3003 and/or 7075. The plurality of reinforcing wires are made of a material selected from a group consisting of iron (Fe), copper (Cu), nickel (Ni), titanium (Ti), and alloys thereof. The outer coating layer is made of a material selected from a group consisting of zinc, zinc-magnesium, zinc-magnesium-aluminum, copper, and copper-zinc.

In other features, the outer coating layer includes a zinc-based alloy that melts during extrusion to create liquid diffusion bond. The outer coating layer includes a copper-based alloy that does not melt during extrusion and creates a solid-state diffusion bond.

A co-extruded part includes an aluminum extrusion and a plurality of reinforcing wires including an outer layer comprising woven glass fibers. The plurality of reinforcing wires are made of a material selected from a group consisting of iron (Fe), copper (Cu), nickel (Ni), titanium (Ti), and alloys thereof. The aluminum extrusion and the plurality of reinforcing wires with the outer layer are co-extruded.

Further areas of applicability of the present disclosure will become apparent from the detailed description, the claims, and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

While extruded parts including aluminum that is co-extruded with insulated, coated and/or non-circularly shaped reinforcing wires are described below in the context of automotive vehicles, the extruded parts can be used in other types of vehicles and/or stationary applications.

Extruded aluminum parts can be used in a variety of applications as a replacement for steel parts to reduce weight. While aluminum has less weight, it also has lower strength. For example, vehicles may include extruded aluminum parts that replace steel structural members in applications such as rockers, rails, or other components. However, some applications for aluminum require higher strength. The thickness of the aluminum can be increased, which increases the cost of the part. Alternately, high strength steel can be used with increased weight.

Recently, aluminum has been co-extruded with steel reinforcing wires to the increase strength of the part. Steel wire-reinforced aluminum extrusions are desirable in vehicle applications due to the combined benefits of light weight and higher stiffness. Prior attempts to coextrude aluminum and steel wire typically employ uncoated spring steel having a uniform, circular cross section. However, the reinforcing wires may not form strong bonds with the extruded aluminum. If the reinforcing wires do not bond to the aluminum or delamination occurs after extrusion due to weak bonds, the part will have less strength since the reinforcing wires will have significantly lower pullout resistance.

The co-extruded parts according to the present disclosure include co-extruded aluminum and reinforcing wires. In some examples, the reinforcing wires are insulated and/or coated, and/or reinforcing wires having a non-circular cross section are used. The coated reinforcing wires form stronger bonds with the aluminum (e.g., liquid or solid-state diffusion bonds). Reinforcing wires having the non-circular cross section or increased roughness increase pullout resistance since the aluminum flows into grooves in the reinforcing wires.

The outer coating layer provides a medium for bonding the extruded aluminum to the steel reinforcing wires. For example, the outer coating layer may include a material such as zinc, zinc-magnesium, zinc-magnesium-aluminum, copper, and copper-zinc.

In some examples, the reinforcing wires include an insulating layer to allow the reinforcing wires to be insulated from the extruded aluminum and other reinforcing wires. As a result, the reinforcing wires can be used to carry electrical signals from one location to another.

Figure 1A:
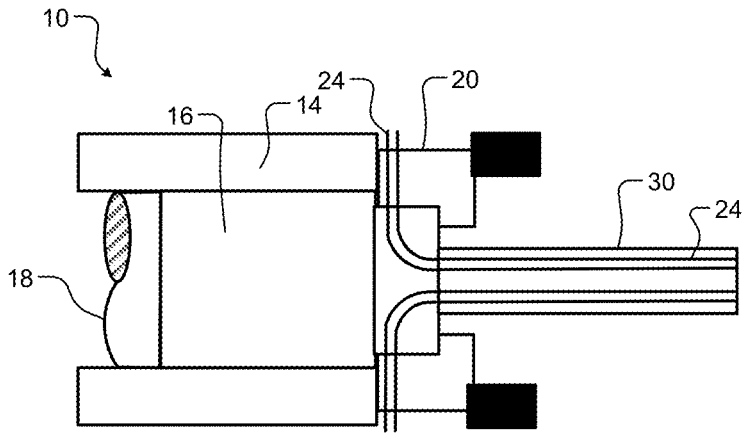
FIG. 1A is a side cross section of an example of a composite extrusion die configured to co-extrude aluminum and reinforcing wire that is insulated, coated and/or has a non-circular cross section according to the present disclosure.

Referring now to FIG. 1A, an example of a co-extrusion system 10 is shown. The co-extrusion system 10 includes a container 14 including an inner cavity to receive heated aluminum 16 (or billet). A piston 18 or other device moves reciprocally to change/reduce a volume of the inner cavity and force the softened aluminum through a composite extrusion die 20 under pressure. The composite extrusion die 20 produces a co-extruded part 30 with co-extruded reinforcing wires 24 embedded therein.

In some examples, the composite extrusion die 20 includes a cover plate including first and second openings for receiving heated aluminum. A feeder plate is arranged adjacent to the cover plate and includes aligned first and second openings on an inlet side for receiving softened aluminum that flows with pressure. The first and second openings of the feeder plate are combined into a single outlet. The feeder plate further includes wire feed openings to feed reinforcing wires between the first and second openings. The reinforcing wire is guided by the feeder plate into the softened aluminum exiting the feeder plate at the single outlet. A die is arranged adjacent to the feeder plate to shape the co-extruded part. In other examples, the die is a single piece die that directs the reinforcing wires into the extruded aluminum.

Figure 1B:
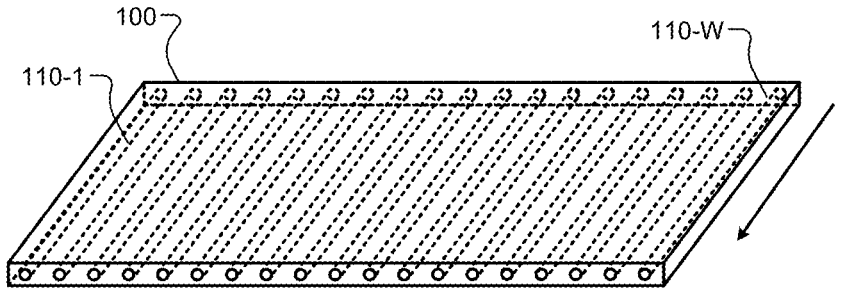
FIG. 1B is a perspective view of an example of an aluminum extrusion including co-extruded reinforcing wires that are insulated, coated and/or have a non-circular cross section according to the present disclosure.

Referring now to FIG. 1B, an example of a co-extruded part 100 (e.g., a plate) including extruded aluminum and a plurality of reinforcing wires 110-1, 110-2, . . . , and 110-W, where W is an integer greater than one. The plurality of reinforcing wires 110-1, 110-2, . . . , and 110-W run parallel to one another and extend longitudinally through the co-extruded part 100 (in an extrusion direction shown by arrow).

As described above, co-extruded parts using uncoated spring steel with a uniform, circular cross-section tend to delaminate easily. The uncoated spring steel typically does not have a sufficient bond strength to the extruded aluminum and may detach therefrom, which reduces the strength of the part. Further, the spring steel and aluminum are in direct contact and may experience galvanic corrosion.

Figure 2:
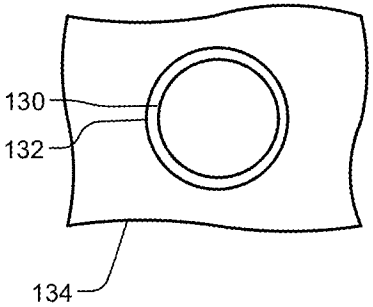
FIG. 2 is a partial side cross section of an example of a co-extruded part including an aluminum extrusion and co-extruded reinforcing wires with an outer coating layer or an insulating layer according to the present disclosure.

Referring now to FIG. 2, in some examples, a co-extruded part includes extruded aluminum 134 and a plurality of reinforcing wires 130 with an outer coating layer 132. The outer coating layer 132 enhances the bond between the material of the plurality of reinforcing wires 130 and the extruded aluminum 134.

In some examples, the extruded aluminum 134 is made of aluminum alloy such as 3xxx, 5xxx, 6,xxx, and 7xxx alloys (e.g., 6034, 6061, 6082, 6282, 7003, 6063, 6005, 6008, 1050, 3103, 3003 and/or 7075), although other types of aluminum can be used. In some examples, the plurality of reinforcing wires 130 are made of a material selected from a group consisting of iron (Fe), copper (Cu), nickel (Ni), titanium (Ti), and alloys of the preceding metals. For example, nickel titanium alloy or Nitinol may be used. In some examples, the plurality of reinforcing wires 130 are made of a material selected from a group consisting of carbon steel (e.g., grades 1009, 1095), austenitic stainless spring steel (e.g., grades 301, 302, 304, 316), and martensitic stainless spring steel (e.g., grades 414, 420, 431, 441, 455), although other types of materials can be used.

In some examples, the outer coating layer is made of a material selected from a group consisting of zinc, zinc-magnesium, zinc-magnesium-aluminum, copper, and copper-zinc. In some examples, the outer coating layer includes a zinc-based alloy that melts during the aluminum extrusion process to create a liquid diffusion bond. In other examples, the outer coating layer includes a copper-based alloy that melts at a temperature above the temperatures used during the extrusion process. While the copper alloy does not melt during the extrusion process, a solid-state diffusion bond is created.

In some examples, the reinforcing wire has a diameter in a range from 0.5 mm to 2 mm. In some examples, the reinforcing wire has a diameter in a range from 0.5 mm to 1 mm. In some examples, a thickness of the outer coating layer is in a range from 1 μm to 50 μm. In some examples, a thickness of the outer coating layer is in a range from 1 μm to 20 μm. In some examples, the surface of the outer coating layer has a surface roughness (Ra) in a range from 10% to 75% of an average thickness T of the outer coating layer. In other examples, the outer surface of the reinforcing wire has a comparable roughness and the outer coating layer has a more uniform thickness.

In applications including an insulating layer to allow the reinforcing wires to transmit signals, the outer coating layer includes an insulating coating having a melting temperature greater than the extrusion temperature. In some examples, the outer coating layer is selected from a group consisting of aluminum nitride (AlN), alumina ($Al_2O_3$), and boron nitride (BN), or other dielectric coatings. In some examples, a woven glass fiber layer surrounds the reinforcing wire. The use of the outer coating layer and/or the woven glass fiber layer allow separate signals to be carried by the reinforcing wires.

Figure 3A:
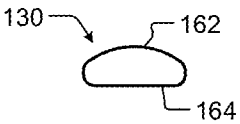
FIGS. 3A to 3F are side cross sections of examples of reinforcing wires having non-circular outer shapes according to the present disclosure.
Figure 3B:
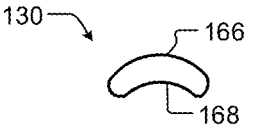
Figure 3C:
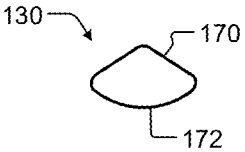
Figure 3D:
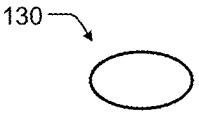
Figure 3E:
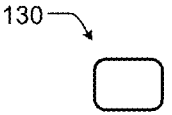
Figure 3F:
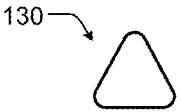

Referring now to FIGS. 3A to 3F, the reinforcing wires 130 according to the present disclosure can have a uniform, circular cross section (as shown in FIG. 2) or a non-circular cross section with or without an outer coating layer. Examples of non-circular shapes are shown in FIGS. 3A to 3F. In FIG. 3A, a wire is "D"-shaped and includes a flat side 164, an arcuate side 162, and rounded transitions. In FIG. 3B, a wire has a crescent shape with a convex side 166, a concave side 168, and rounded transitions. In FIG. 3C, a wire has a pie shape with a "V"-shaped side 170, an arcuate side 172, and rounded transitions. In FIG. 3D, a wire has an elliptical shape. In FIG. 3E, a wire has a rounded rectangular shape. In FIG. 3F, a wire has a rounded triangular shape.

Figure 4A:
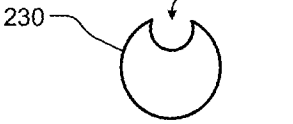
FIGS. 4A and 4B are plan and perspective views, respectively, of an example of a helical wire according to the present disclosure.
Figure 4B:
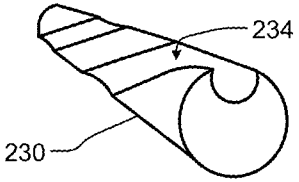

In FIGS. 4A and 4B, a helical wire 230 includes a helical groove 234 that winds helically around an outer surface of the helical wire 230 as shown in FIG. 4B. The aluminum fills the helical groove 234 of the helical wire 230 during extrusion to provide a stronger bond and to enhance pullout resistance during part loading.

Figure 5:
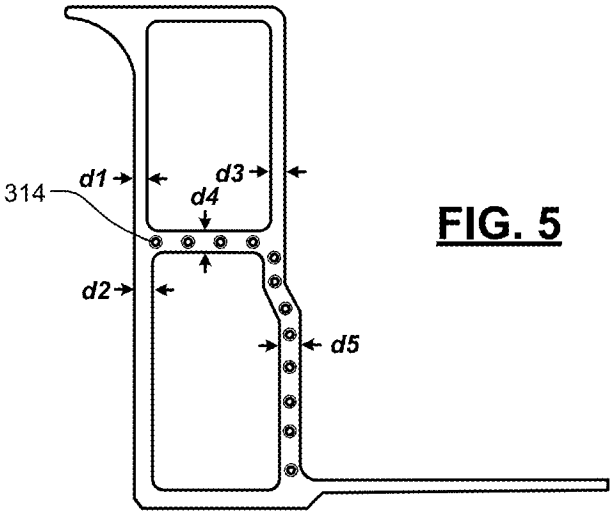
FIG. 5 is a side cross section of an example of a part with co-extruded aluminum and reinforcing wires according to the present disclosure.

Referring now to FIG. 5, the extruded structure can have a more complex shape. In the example in FIG. 5, the extruded structure 310 has a "B" shape with a leg extending therefrom. As can be appreciated, sides of the extruded part 310 have different thicknesses represented by dimensions d1, d2, d3, d4, and d5. In some examples, the thickness of one or more of the dimensions d1, d2, d3, d4, and d5 can be decreased relative to an all-aluminum part without loss of strength when the reinforcing wires 314 are used.

Figure 6:
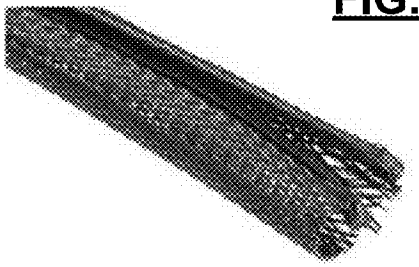
FIG. 6 is a perspective view of an example of an insulating layer including woven glass fibers according to the present disclosure.

Referring now to FIG. 6, in some examples, the reinforcing wire includes an insulating layer made of glass fiber or other insulating material that can withstand the extrusion temperature without melting. For example, an insulating layer including woven glass fibers can be used.

Figure 7A:
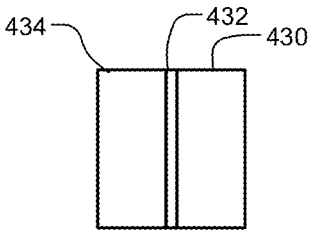
FIGS. 7A to 7C are partial side views illustrating an example of an interface between the extruded aluminum, the outer coating layer, and the reinforcing wire during extrusion according to the present disclosure.
Figure 7B:
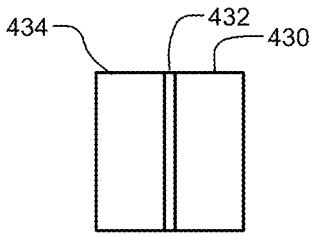
Figure 7C:
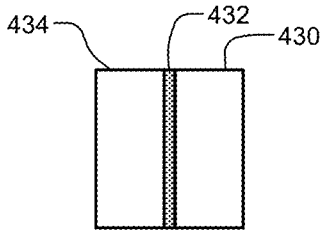
Figure 8:
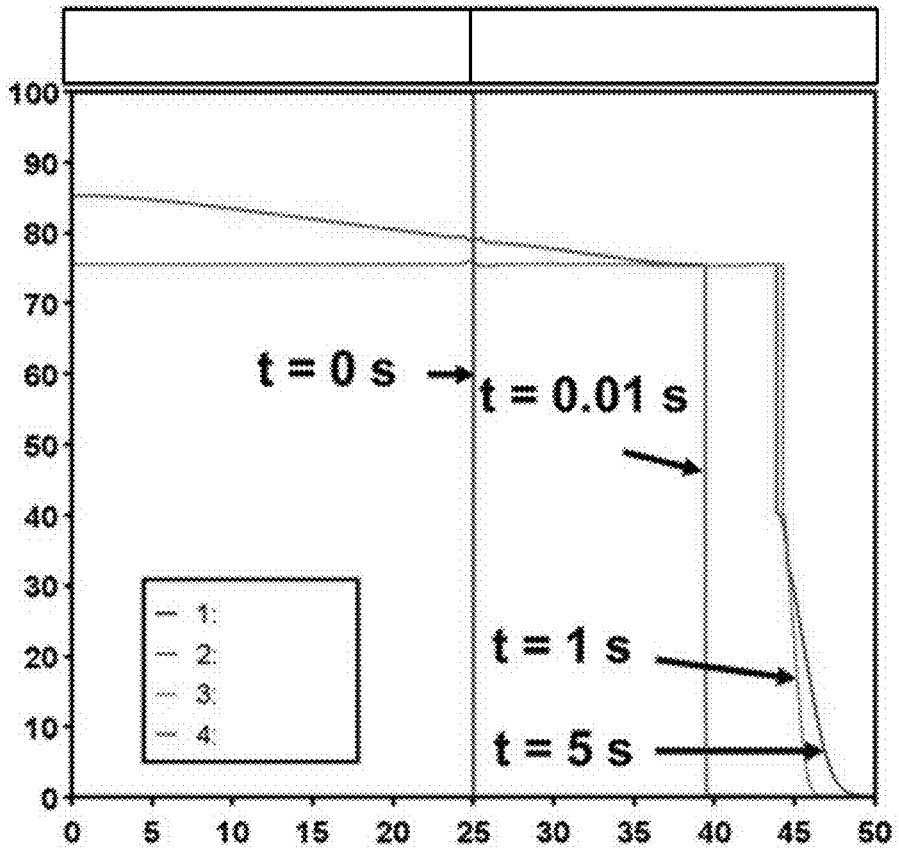
FIG. 8 is a graph showing mass percentage of zinc as a function of distance near the interface between the aluminum extrusion, the outer coating layer, and the reinforcing wire according to the present disclosure.

Referring now to FIGS. 7A to 8, an interface between a wire 430 with an outer coating layer 432 and extruded aluminum 434 is shown. The outer coating layer 432 may melt during co-extrusion when the melting temperature of the outer coating layer 432 is less than or equal to the extrusion temperature (approximately 450° C. to 550° C.). For example, some zinc-based coatings have melting temperatures less than or equal to the extrusion temperature. When the outer coating layer 432 melts, liquid state bonding of the coating to the aluminum 434 occurs.

In FIG. 7A, the zinc-coated wire and the aluminum are co-extruded. The high temperature of the aluminum 434 heats the outer coating layer 432 causing melting in FIG. 7B. In FIG. 7C, the liquid zinc from the outer coating layer 432 reacts with the melted aluminum to form a bond therebetween as can be seen in the simulation in FIG. 8.

Figure 9A:
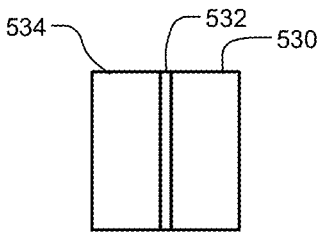
FIGS. 9A and 9B are partial side views illustrating an example of an interface between the extruded aluminum, the outer coating layer, and the reinforcing wire during extrusion according to the present disclosure.
Figure 9B:
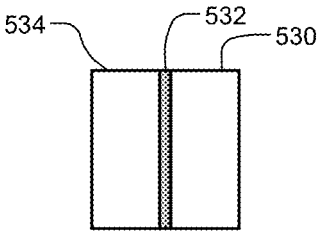
Figure 10:
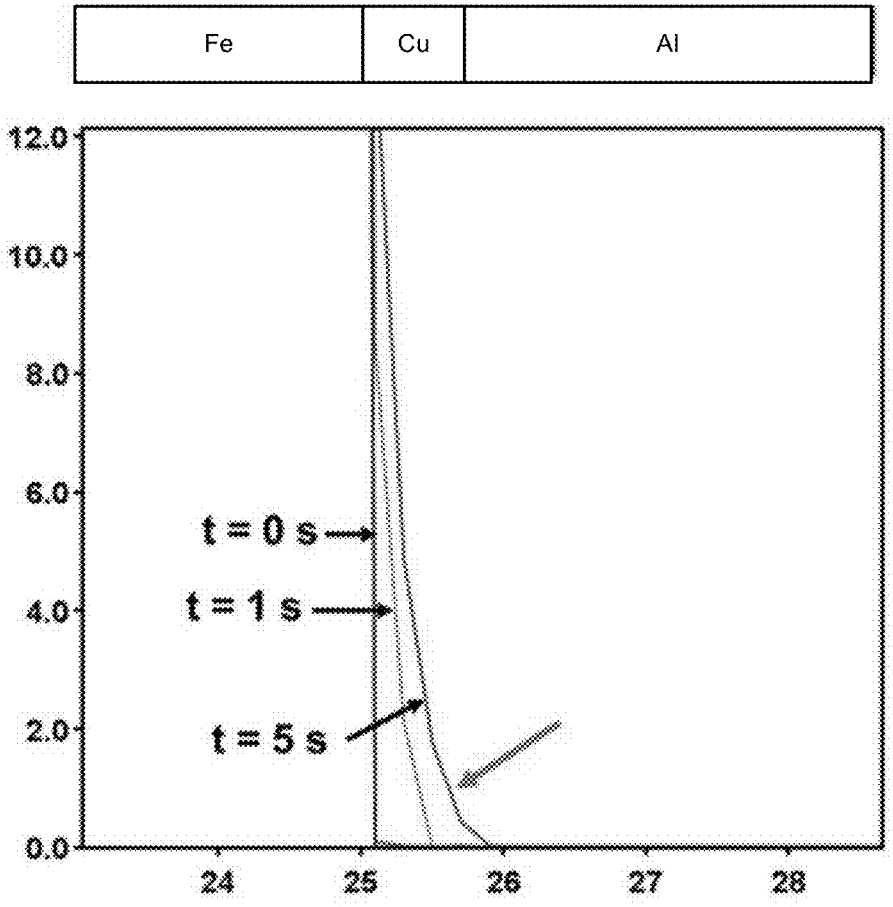
FIG. 10 is a graph showing the mass percentage of copper as a function of distance near the interface between the aluminum extrusion and the outer coating layer according to the present disclosure.

Referring now to FIGS. 9A to 10, an interface between a wire 530 with an outer coating layer 532 and aluminum 534 is shown. The temperature during co-extrusion may not be sufficiently high to cause melting of the outer coating layer 532. For example, the outer coating layer 532 may include a copper or a copper-zinc coating. While melting does not occur, the temperature may be sufficiently high to cause solid-state diffusion bonding of the outer coating layer 532 to the extruded aluminum. In other words, the outer coating layer 532 acts as a medium for solid-state diffusion bonding of the extruded aluminum 534 to the copper. For example, the copper diffuses into the aluminum. In FIG. 9A, the reinforcing wire 530 with the outer coating layer 532 and the aluminum 534 are co-extruded. In FIGS. 9B and 10, the high temperature of the aluminum 534 heats the outer coating layer 532 and causes the copper to diffuse into the aluminum (e.g., solid-state diffusion bonding).

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

What is claimed is:

1. A co-extruded part comprising:

an aluminum extrusion; and a plurality of reinforcing wires including an outer coating layer and arranged in the aluminum extrusion, wherein the plurality of reinforcing wires are co-extruded with the aluminum extrusion, and wherein the outer coating layer includes a copper-based alloy that does not melt during extrusion to create a solid-state diffusion bond.

2. The co-extruded part of claim 1, wherein the aluminum extrusion includes an aluminum alloy selected from a group consisting of 6034, 6061, 6082, 6282, 7003, 6063, 6005, 6008, 1050, 3103, 3003, and 7075.

3. The co-extruded part of claim 1, wherein the plurality of reinforcing wires include a material selected from a group consisting of iron (Fe), copper (Cu), nickel (Ni), titanium (Ti), and alloys thereof.

4. The co-extruded part of claim 1, wherein the plurality of reinforcing wires include a material selected from a group consisting of carbon steel, austenitic stainless spring steel, and martensitic stainless spring steel.

5. A co-extruded part comprising:

an aluminum extrusion; and a plurality of reinforcing wires including an outer coating layer and arranged in the aluminum extrusion, wherein the plurality of reinforcing wires are co-extruded with the aluminum extrusion, and wherein the plurality of reinforcing wires comprise helical reinforcing wires including a longitudinal helical groove.

6. The co-extruded part of claim 1, wherein the plurality of reinforcing wires have a circular cross section and a diameter in a range from 0.5 mm to 2 mm.

7. The co-extruded part of claim 1, wherein a thickness of the outer coating layer is in a range from 1 μm to 50 μm.

8. The co-extruded part of claim 1, wherein a surface of the outer coating layer has a surface roughness (Ra) in a range from 10% to 75% of an average thickness T of the outer coating layer.

9. A co-extruded part comprising:

an aluminum extrusion; and a plurality of reinforcing wires including an outer coating layer and arranged in the aluminum extrusion, wherein the plurality of reinforcing wires are co-extruded with the aluminum extrusion, and wherein the outer coating layer includes an insulating layer selected from a group consisting of aluminum nitride (AlN), alumina ($Al_2O_3$), and boron nitride (BN).

10. The co-extruded part of claim 9, wherein the plurality of reinforcing wires have a non-circular cross section.

11. The co-extruded part of claim 9, wherein:

the aluminum extrusion includes an aluminum alloy selected from a group consisting of 6034, 6061, 6082, 6282, 7003, 6063, 6005, 6008, 1050, 3103, 3003, and 7075, and the plurality of reinforcing wires include a material selected from a group consisting of iron (Fe), copper (Cu), nickel (Ni), titanium (Ti), and alloys thereof.

12. The co-extruded part of claim 9, wherein:

the aluminum extrusion includes an aluminum alloy selected from a group consisting of 6034, 6061, 6082, 6282, 7003, 6063, 6005, 6008, 1050, 3103, 3003, and 7075, and the plurality of reinforcing wires include a material selected from a group consisting of carbon steel, austenitic stainless spring steel, and martensitic stainless spring steel.

13. The co-extruded part of claim 9, wherein:

the plurality of reinforcing wires have a circular cross section and a diameter in a range from 0.5 mm to 2 mm, and a thickness of the outer coating layer is in a range from 1 μm to 50 μm.

14. The co-extruded part of claim 5, wherein the outer coating layer includes a material selected from a group consisting of zinc, zinc-magnesium, zinc-magnesium-aluminum, copper, and copper-zinc.

15. The co-extruded part of claim 5, wherein the outer coating layer includes a zinc-based alloy that melts during extrusion to create a liquid diffusion bond.

16. The co-extruded part of claim 5, wherein:

the aluminum extrusion includes an aluminum alloy selected from a group consisting of 6034, 6061, 6082, 6282, 7003, 6063, 6005, 6008, 1050, 3103, 3003, and 7075, and the plurality of reinforcing wires include a material selected from a group consisting of iron (Fe), copper (Cu), nickel (Ni), titanium (Ti), and alloys thereof.

17. The co-extruded part of claim 5, wherein:

the aluminum extrusion includes an aluminum alloy selected from a group consisting of 6034, 6061, 6082, 6282, 7003, 6063, 6005, 6008, 1050, 3103, 3003, and 7075, and the plurality of reinforcing wires include a material selected from a group consisting of carbon steel, austenitic stainless spring steel, and martensitic stainless spring steel.

18. A co-extruded part comprising:

an aluminum extrusion; and a plurality of reinforcing wires including an outer layer comprising woven glass fibers, wherein the plurality of reinforcing wires are made of a material selected from a group consisting of iron (Fe), copper (Cu), nickel (Ni), titanium (Ti), and alloys thereof, and wherein the aluminum extrusion and the plurality of reinforcing wires with the outer layer are co-extruded.

19. The co-extruded part of claim 18, wherein:

the plurality of reinforcing wires includes an outer coating layer; and a surface of the outer coating layer has a surface roughness (Ra) in a range from 10% to 75% of an average thickness T of the outer coating layer.

20. The co-extruded part of claim 18, wherein the plurality of reinforcing wires have a non-circular cross section.

* * * * *